US007850100B2

(12) United States Patent
Cagnolati et al.

(10) Patent No.: US 7,850,100 B2
(45) Date of Patent: Dec. 14, 2010

(54) ELECTROMAGNETIC FUEL INJECTOR FOR A DIRECT INJECTION INTERNAL COMBUSTION ENGINE

(75) Inventors: Luca Cagnolati, Bologna (IT); Massimo Mattioli, Calderara Di Reno (IT); Marcello Cristiani, Imola (IT)

(73) Assignee: Magneti Marelli Powertrain S.p.A., Corbetta (IT)

( * ) Notice: Subject to any disclaimer, the term of this patent is extended or adjusted under 35 U.S.C. 154(b) by 351 days.

(21) Appl. No.: 12/001,998

(22) Filed: Dec. 12, 2007

(65) Prior Publication Data

US 2008/0156906 A1 Jul. 3, 2008

(30) Foreign Application Priority Data

Dec. 12, 2006 (EP) ..... 06425829

(51) Int. Cl.
*F02M 51/00* (2006.01)

(52) U.S. Cl. ..... 239/585.4; 239/533.1; 239/585.1; 239/900; 239/DIG. 19

(58) Field of Classification Search ... 239/585.1–585.5, 239/900, 533.11, 533.12; 251/129.15–129.21
See application file for complete search history.

(56) References Cited

U.S. PATENT DOCUMENTS

| | | | | |
|---|---|---|---|---|
| 5,944,262 | A | 8/1999 | Akutagawa et al. | |
| 5,996,910 | A * | 12/1999 | Takeda et al. | 239/585.1 |
| 6,386,467 | B1 * | 5/2002 | Takeda | 239/585.5 |
| 6,523,756 | B2 * | 2/2003 | Dallmeyer et al. | 239/900 |
| 2002/0139873 | A1 | 10/2002 | Ito et al. | |
| 2003/0127544 | A1 | 7/2003 | Demere et al. | |
| 2003/0141390 | A1 | 7/2003 | Matsuo et al. | |
| 2006/0022161 | A1 | 2/2006 | Yamashita | |

FOREIGN PATENT DOCUMENTS

| | | |
|---|---|---|
| DE | 100 31 686 | 3/2001 |
| DE | 103 32 812 A1 | 2/2005 |
| EP | 1 619 383 A | 1/2006 |
| EP | 1 619 384 A | 1/2006 |
| EP | 1 635 055 A | 3/2006 |
| GB | 398 488 | 9/1933 |
| JP | 54 092017 | 7/1979 |

OTHER PUBLICATIONS

EPO Search Report for 06425829.6-2311.

* cited by examiner

*Primary Examiner*—Steven J Ganey
(74) *Attorney, Agent, or Firm*—Kevin D. Jablonski; Graybeal Jackson LLP

(57) ABSTRACT

An embodiment of a fuel injector comprising: an injection valve provided with a mobile needle for regulating the fuel flow through an injection nozzle; a supporting body having a tubular shaft and displaying a feeding channel which ends with the injection valve; and an electromagnetic actuator comprising a spring which tends to maintain the needle in a closing position and an electromagnet, which comprises a coil arranged outside the supporting body, a fixed magnetic armature arranged within the supporting body, and a keeper which is arranged within the supporting body, is magnetically attracted by the magnetic armature against the bias of the spring, and is mechanically connected to the needle; the coil displaying a toroidal shape having an internal annular surface, which is directly in contact with an external surface of the supporting body without the interposition of any intermediate element.

39 Claims, 3 Drawing Sheets

ELECTROMAGNETIC FUEL INJECTOR FOR A DIRECT INJECTION INTERNAL COMBUSTION ENGINE

PRIORITY CLAIM

This application claims priority from European patent application No. 06425829.6, filed Dec. 12, 2006, which is incorporated herein by reference.

TECHNICAL FIELD

An embodiment of the present invention relates to an electromagnetic fuel injector for a direct injection internal combustion engine.

BACKGROUND

An electromagnetic fuel injector (for example of the type described in patent application EP1635055A1, which is incorporated by reference) comprises a cylindrical tubular body displaying a central feeding channel, which performs the fuel conveying function and ends with an injection nozzle regulated by an injection valve controlled by an electromagnetic actuator. The injection valve is provided with a needle, which is rigidly connected to a mobile keeper of the electromagnetic actuator between a closing position and an opening position of the injection nozzle against the bias of a spring which tends to maintain the needle in closing position. The valve seat is defined by a sealing element, which is shaped as a disc, lowerly and fluid-tightly closes the central channel of the support body and is crossed by the injection nozzle.

The driving time-injected fuel quantity curve (i.e. the law which binds the driving time to the quantity of injected fuel) of an electromagnetic injector is on a whole rather linear, but displays an initial step (i.e. displays a step increase at shorter driving times and thus at smaller quantities of injected fuel). In order words, an electromagnetic injector displays inertias of mechanical origin and above all of magnetic origin which limit the displacement speed of the needle and therefore an electromagnetic injector is not capable of performing injections of very reduced amounts of fuel with the necessary precision.

Conventionally, the capacity of performing fuel injections of very reduced duration with the necessary precision is expressed by a parameter called "Linear Flow Range" which is defined as the ratio between maximum injection and minimum injection in linear ratio.

Due to the relatively high "Linear Flow Range", an electromagnetic injector may be used in a direct injection internal combustion engine in which the injector is not driven to inject small amounts of fuel; instead, an electromagnetic injector cannot be used in a direct injection internal combustion engine, in which the injector is constantly driven to inject small amounts of fuel so as to perform a series of pilot injections before the main injection (e.g. as occurs in an Otto cycle internal combustion engine provided with turbo charger).

In order to obtain an injector with a high "Linear Flow Range", it has been suggested to use a piezoelectric actuator instead of the traditional electromagnetic actuator. A piezoelectric injector is very fast and thus display a high "Linear Flow Range"; however, a piezoelectric injector is much more expensive than an equivalent electromagnetic injector due to the high cost of piezoelectric materials. By way of example, the cost of a piezoelectric injector may even be three times the cost of an equivalent electromagnetic injector.

In order to obtain an injector having a high "Linear Flow Range" it has also been suggested to make a multipolar electromagnetic actuator instead of a traditional monopolar electromagnetic actuator; however, a multipolar electromagnetic actuator displays considerably higher production costs with respect to a traditional injector with monopolar electromagnetic actuator.

SUMMARY

An embodiment of the present invention provides an electromagnetic fuel injector for a direct injection internal combustion engine, which is free from the drawbacks described above, and in particular, is easy and cost-effective to implement.

BRIEF DESCRIPTION OF THE DRAWINGS

One or more embodiments of the present invention will now be described with reference to the accompanying drawings which illustrate a non-limitative example of embodiment thereof, in which.

DETAILED DESCRIPTION

Figure 1:
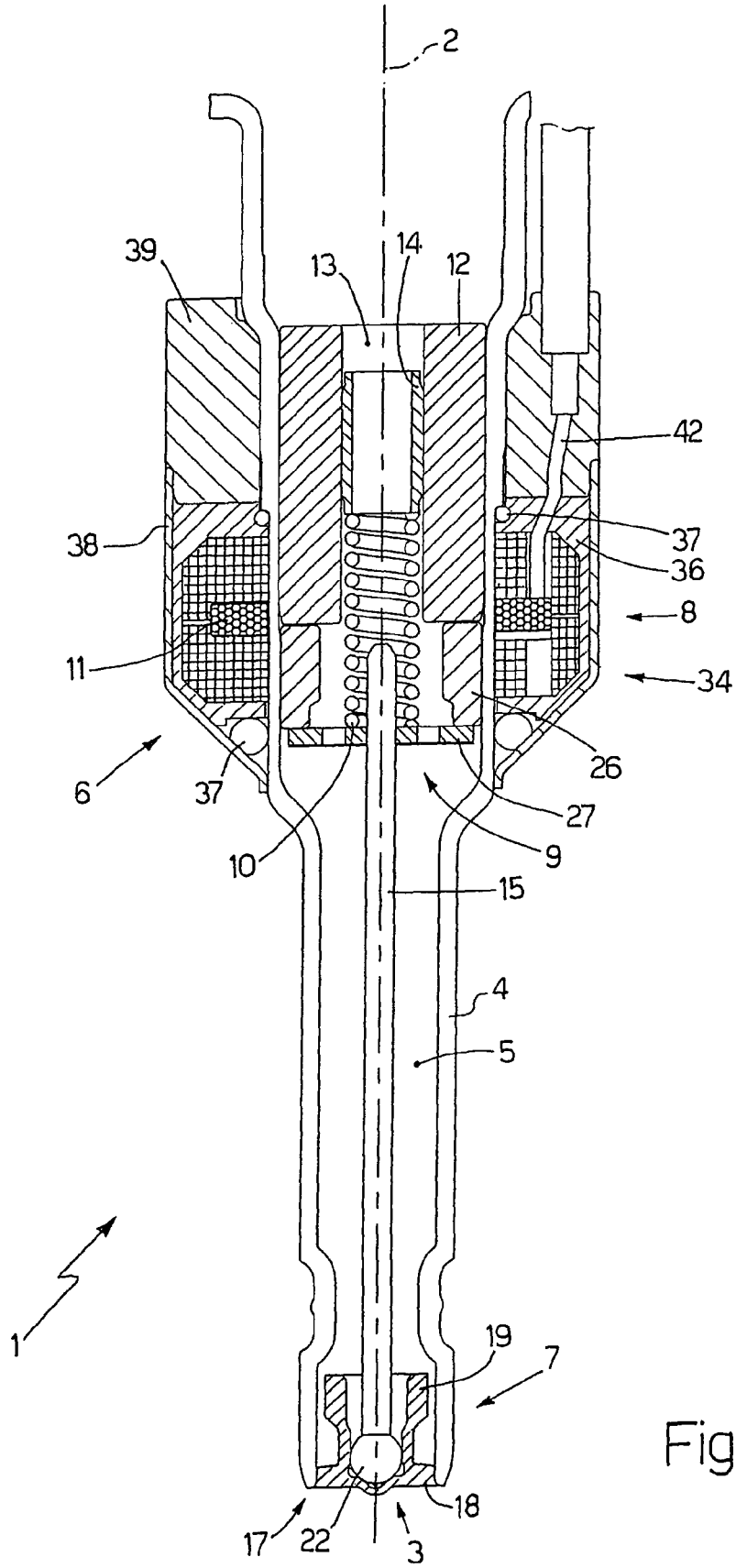
FIG. 1 is a schematic view, in side section and with parts removed for clarity, of a fuel injector made according to an embodiment of the present invention.

In FIG. 1, number 1 indicates as a whole a fuel injector, which displays an substantially cylindrical symmetry about a longitudinal axis 2 and is adapted to be controlled to inject fuel from an injection nozzle 3 which leads directly into a combustion chamber (not shown) of a cylinder. Injector 1 comprises a supporting body 4, which has a variable section cylindrical tubular shape along longitudinal axis 2 and displays a feeding channel 5 extending along the entire length of supporting body 4 itself to feed pressurized fuel towards injection nozzle 3. Supporting body 4 accommodates an electromagnetic actuator 6 at an upper portion and an injection valve 7 at a lower portion; in use, injection valve 7 is actuated by electromagnetic actuator 6 to adjust the fuel flow through injection nozzle 3, which is obtained at injection valve 7 itself.

Electromagnetic actuator 6 comprises an electromagnet 8, which is accommodated in fixed position within supporting body 4 and when energized is adapted to displace a ferromagnetic material keeper 9 along axis 2 from a closing position to an opening position of injection valve 7 against the bias of a spring 10 which tends to maintain keeper 9 in the closing position of injection valve 7. In particular, electromagnet 8 comprises a coil 11, which is electrically fed by a driving control unit (not shown) and is externally accommodated with respect to supporting body 4, and a magnetic armature, which is accommodated within supporting body 4 and displays a central hole 13 for allowing the fuel flow towards injection nozzle 3. A catch body 14 which displays a tubular cylindrical shape (possibly open along a generating line) to allow the fuel flow towards injection nozzle 3 is adapted to maintain spring 10 compressed against keeper 9 and is fitted in fixed position within central hole 13 of magnetic armature 12.

Keeper 9 is part of a mobile equipment, which further comprises a shutter or needle 15, having an upper portion integral with keeper 9 and a lower portion cooperating with a valve seat 16 (shown in FIG. 3) of injection valve 7 to adjust the fuel flow through injection nozzle 3 in a known way.

Figure 3:
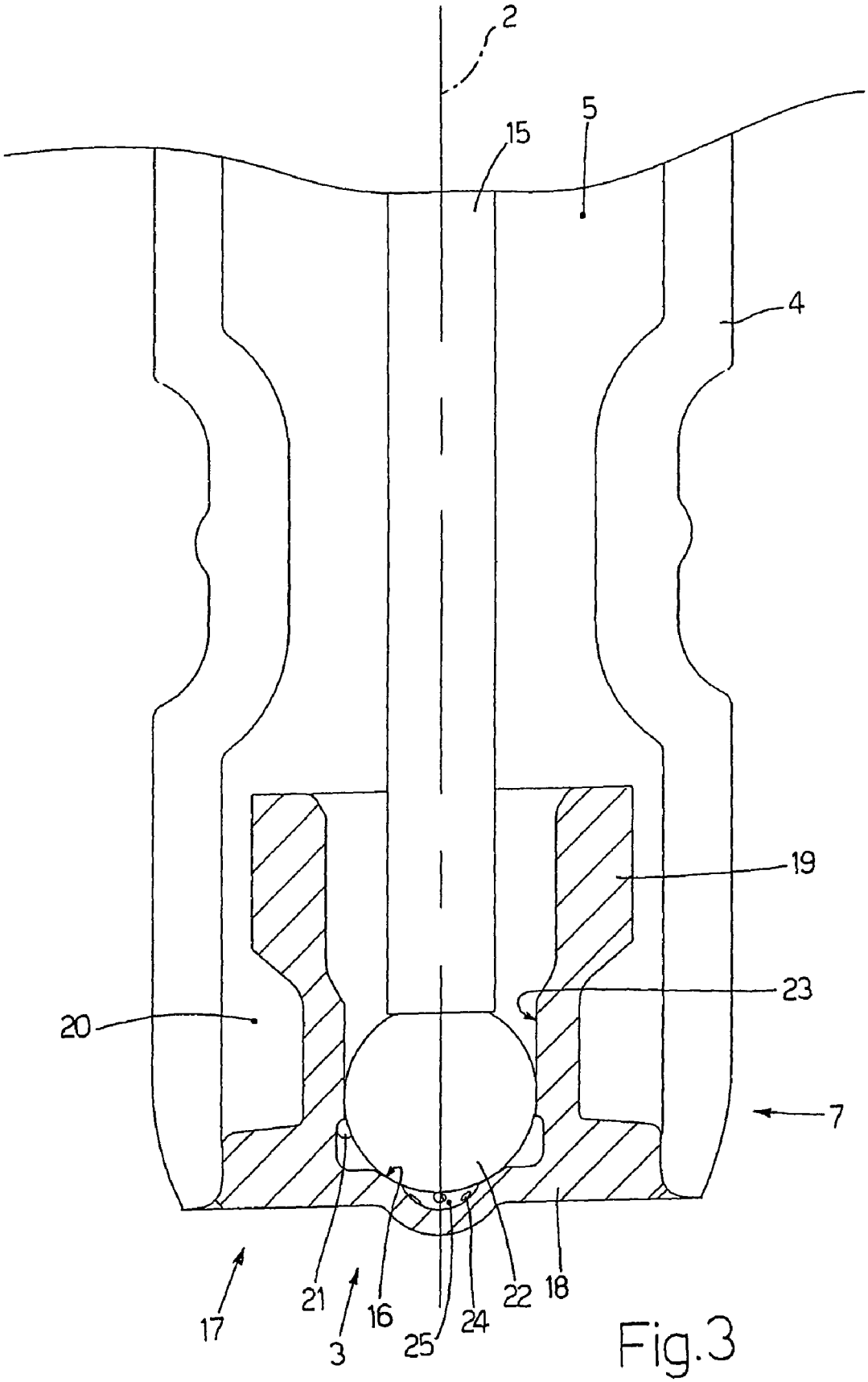
FIG. 3 shows on a magnified scale, an injection valve of an injector in FIG. 1.

As shown in FIG. 3, valve seat 16 is defined in a sealing body 17, which is monolithic and comprises a disc-shaped cap element 18, which lowerly and fluid-tightly closes feeding channel 5 of supporting body 4 and is crossed by injection nozzle 3. From cap element 18 rises a guiding element 19, which has a tubular shape, accommodates within a needle 15 for defining a lower guide of the needle 15 itself and displays an external diameter smaller than the internal diameter of feeding channel 5 of supporting body 4, so as to define an external annular channel 20 through which the pressurized fuel may flow.

Four through feeding holes 21 (only one of which is shown in FIG. 3), which lead towards valve seat 16 to allow the flow of pressurized fuel towards valve seat 16 itself, are obtained in the lower part of guiding element 19. Feeding holes 21 may either be offset with respect to a longitudinal axis 2 so as not to converge towards longitudinal axis 2 itself and to impress in use a vortical flow to the corresponding fuel flows, or feeding holes 21 may converge towards longitudinal axis 2. 9 Feeding holes 21 are arranged slanted by a 70° angle (more in general, from 60° to 80°) with respect to longitudinal axis 2; according to a different embodiment, feeding holes 21 form a 90° angle with longitudinal axis 2.

Needle 15 ends with a substantially spherical shutter head 22, which is adapted to fluid-tightly rest against valve seat 16; alternatively, shutter head 22 may be substantially cylindrical shaped and have only a spherically shaped abutting zone. Furthermore, shutter head 22 slidingly rests on an internal surface 23 of guiding element 19 so as to be guided in its movement along longitudinal axis 2. Injection nozzle 3 is defined by a plurality of through injection holes 24, which are obtained from an injection chamber 25 arranged downstream of the valves seat 16; injection chamber 25 may have a semi-spherical shape (as shown in FIG. 3), a truncated cone shape or also any other shape.

Figure 2:
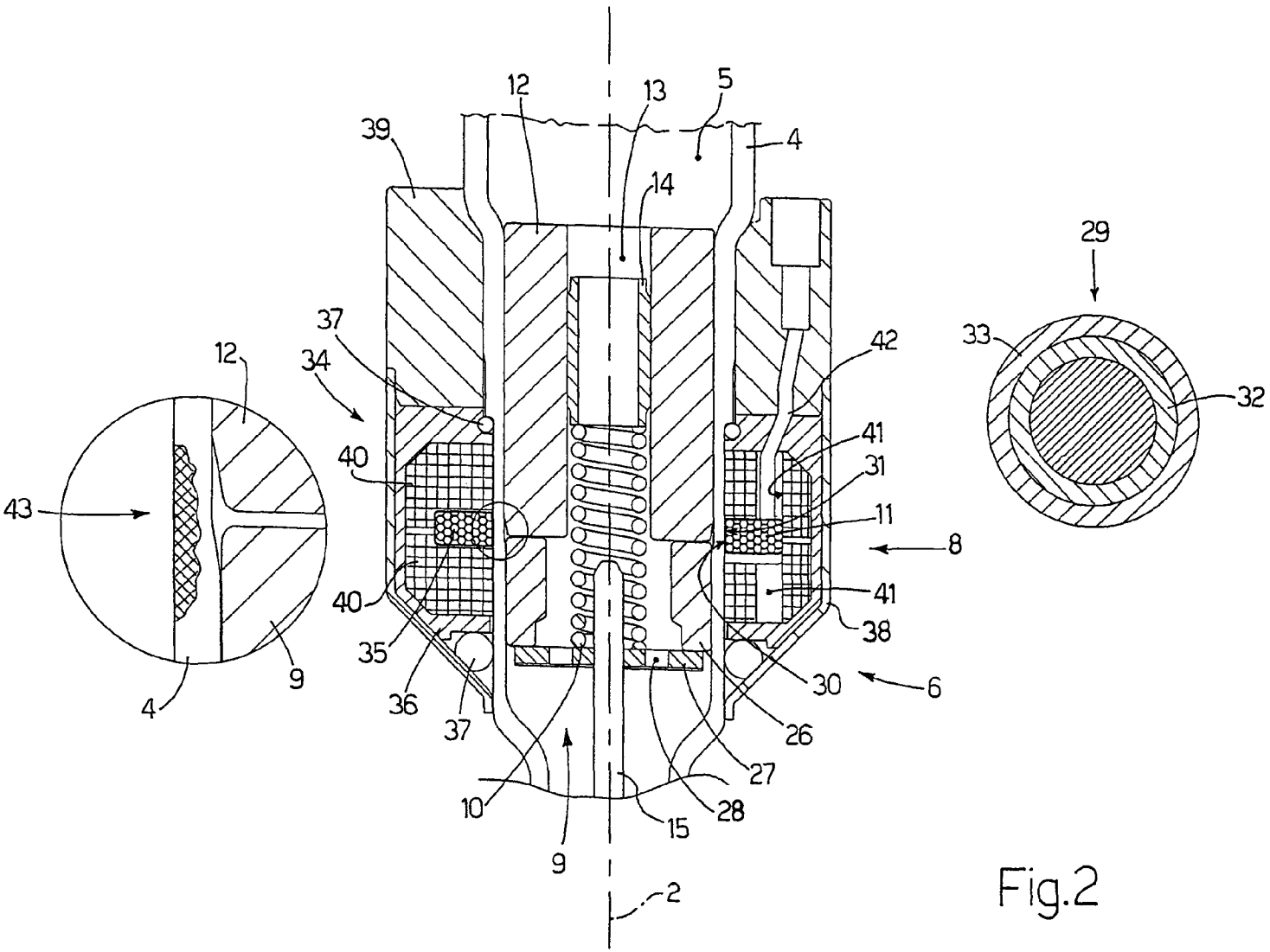
FIG. 2 shows on a magnified scale, an electromagnetic actuator of the injector in FIG. 1.

As shown in FIG. 2, keeper 9 is a monolithic body and comprises an annular element 26 and a discoid element 27, which lowerly closes annular element 26 and displays a central through hole adapted to receive an upper portion of needle 15 and a plurality of peripheral through holes 28 (only two of which are shown in FIG. 3) adapted to allow the fuel flow towards injection nozzle 3. A central portion of discoid element 27 is appropriately shaped, so as to accommodate and maintain in position a lower end of spring 10. Preferably, needle 15 is made integral with discoid element 27 of keeper 9 by means of an annular welding.

Annular element 26 of keeper 9 displays an external diameter substantially identical to the internal diameter of the corresponding portion of feeding channel 5 on supporting body 4; in this way, keeper 9 may slide with respect to supporting body 4 along longitudinal axis 2, but may not move transversally along longitudinal axis with respect to supporting body 4 at all. Since needle 15 is rigidly connected to keeper 9, it is apparent that keeper 9 also functions as upper guide of needle 15; consequently, needle 15 is upperly guided by keeper 9 and lowerly guided by guiding element 19.

According to a possible embodiment, an anti-rebound device, which is adapted to attenuate the rebound of shutter head 22 of needle 15 against valve seat 16 when needle 15 is displaced from the opening position to the closing position of injection valve 7, is connected to the lower face of discoid element 27 of keeper 9.

As shown in FIG. 2, coil 11 is arranged outside supporting body 4 and is formed by a wire 29 formed by conductive material wound to form a plurality of turns. Coil 11 displays a toroidal shape having an annular internal surface 30, which is defined by the internal turns of wire 29 and is directly in contact with an external surface 31 of supporting body 4 without the interposition of any intermediate element. In other words, coil 11 is "wound in air" without the use of any internal supporting spool and subsequently locked in the wound configuration so as to be fitted about supporting body 4.

According to an embodiment, wire 29 which constitutes coil 11 is of the self-cementing type and is coated with an internal layer 32 of insulating material and with an external layer 33 of cementing material which fuses at a temperature lower than that of the insulating material of the internal layer 32. Once coil 11 is wound, wire 29 is heated (by means of an external source of heat or by Joule effect by making an intense electrical current circulate along the wire) so as to cause the fusion of the external layer 33 of cementing material without damaging the internal layer 32 of insulating material; consequently, once cooled, coil 11 displays a proper stability of shape which allows the subsequent mounting of coil 11 itself.

According to an embodiment shown in the attached figures coil 11 displays a "squashed" shape; in other words, an axially measured height of the coil 11 (i.e. parallelly to longitudinal axis 2) is smaller than a radially measured width of coil 11 (i.e. perpendicular to longitudinal axis 2).

Electromagnet 8 comprises an external toroidal magnetic core 34, which is arranged externally to supporting body 4 and surrounds coil 11 which is inserted in an annular cavity 35 obtained within magnetic core 34 itself. According to an embodiment, external magnetic core 34 is formed by a ferromagnetic material having a high electric resistivity; in this manner, it is possible to reduce the effect of eddy currents. Specifically, external magnetic core 34 is formed by a ferromagnetic material with an electrical resistivity at least equal to 100 μΩ*m (a standard ferromagnetic materials such as steel 430F displays an electrical resistivity of approximately 0.62 μΩ*m). For example, magnetic core 34 could be formed by Somalloy 500 having an electrical resistivity of approximately μΩ*m, or of Somalloy 700 having an electrical resistivity of approximately 400 μΩ*m; according to an embodiment, magnetic core 34 could be formed by Somalloy 3P having an electric resistivity of approximately 550 μΩ*m.

Somalloy 3P displays good magnetic properties and a high electrical resistivity; on the other hand, such material is mechanically very fragile and not very resistant to chemical attacks of external elements. Consequently, magnetic core 34 is inserted within a toroidal coating liner 36, which is formed by plastic material and co-moulded with magnetic core 34. Furthermore, a pair of annular seals 37, which are arranged about supporting body 4, in contact with toroidal coating liner 36, are contemplated and on opposite sides of toroidal coating liner 36 so as to avoid infiltrations within toroidal coating liner 36 itself.

In virtue of the presence of coating liner 36 and of annular seals 37, magnetic core 34 formed by Somalloy 3P is adequately protected from both mechanical stresses and chemical attacks of external elements; consequently, electromagnet 8 may display a high reliability and a long working life.

Furthermore, a metallic tube 38, which is preferably fitted by interference onto supporting body 4 and is further fitted about toroidal coating liner 36, is contemplated as further protection. On the bottom, metallic tube 38 displays a truncated cone portion so as to fully enclose coating liner 36; instead, on top of coating liner 36 an annular cap 39 formed by plastic material is contemplated (normally formed by two reciprocally fitted halves) whose function is to maintain coating liner 36 in position and to increase the overall mechanical resistance of fuel injector 1. Annular cap 39 is formed by an internal metallic washer externally surrounded by a plastic washer co-moulded to it.

According to an embodiment, external magnetic core 34 comprises two toroidal magnetic semi-cores 40, which are reciprocally overlapped so as to define therebetween annular cavity 35 in which coil 11 is arranged. Each magnetic core 34 is obtained by sintering, i.e. the magnetic material in powder is arranged within a sintering mould and is formed by pressure.

A magnetic semi-core 34 displays an axial conduit 41 (i.e. parallel to longitudinal axis 2) to define a passage for an electrical power wire 42 of coil 11. In order to reduce the number of parts, preferably the two magnetic semi-cores 40 are reciprocally identical; consequently, both magnetic semi-cores 40 display respective axial conduits 41, only one of which is engaged by electrical power wire 42 of coil 11.

According to an embodiment, the construction of magnetic core 34 contemplates to arrange a first magnetic semi-core 34 within a mould (not shown), to arrange coil 11 within the mould and over the first magnetic semi-core 34, to arrange a second magnetic semi-core 34 within the mould and over the first magnetic semi-core 34 so as to form magnetic core 34 and to enclose the coil along with first magnetic semi-core 34, and finally to inject the plastic material within the mould to form toroidal coating liner 36 about magnetic core 34.

It is important to observe that the dimension of coil 11 is minimized by adopting, instead of traditional overmoulding on a spool, a spool-less winding (winding in air) and an external overmoulding (coating liner 36) to magnetic core 34 (formed by high resistivity sintered material) with insulation of coil 11 and magnetic core 34 from the external environment by means of two annular seals 37.

In order to reduce the dispersed magnetic flow which does not cross magnetic armature 12 and keeper 9, supporting body 4 (formed by ferromagnetic material) displays a substantially non-magnetic intermediate portion 43, which is arranged at the gap between magnetic armature 12 and keeper 9. Specifically, non-magnetic portion 43 is formed by a local contribution of non-magnetic material (e.g. nickel). In other words, a welding with contribution of nickel allows it to make supporting body 4 non-magnetic at the gap between magnetic armature 12 and keeper 9.

According to an embodiment, the making of non-magnetic intermediate portion 43 contemplates making supporting body 4 entirely of magnetic material, which is homogenous and uniform along the entire supporting body 4, arranging a ring of non-magnetic material about supporting body 4 and at the position of the gap between magnetic armature 12 and keeper 9, and fusing (e.g. by means of a laser beam) the ring of non-magnetic material for obtaining a local contribution of the non-magnetic material in supporting body 4.

In use, when electromagnet 8 is de-energized, keeper 9 is not attracted by magnetic armature 12 and the elastic force of spring 10 pushes keeper 9 downwards along with needle 15; in this situation, shutter head 22 of needle 15 is pressed against valve seat 16 of injection valve 7, isolating injection nozzle 3 from the pressurized fuel. When electromagnet 8 is energized, keeper 9 is magnetically attracted by armature 12 against the elastic bias of spring 10 and keeper 9 along with needle 15 is displaced upwards, coming into contact with magnetic armature 12 itself; in this situation, shutter head 22 of needle 15 is raised with respect to valve seat 16 of injection valve 7 and the pressurized fuel may flow through injection nozzle 3.

As shown in FIG. 3, when shutter head 22 of needle 15 is raised with respect to valve seat 16, the fuel reaches injection chamber 25 from injection nozzle 3 through external annular channel 20 and then crosses the four feeding holes 21; in other words, when shutter head 22 is raised with respect to valve seat 16, the fuel reaches injection chamber 25 of injection nozzle 3 lapping on the entire external side surface of guiding element 19.

Fuel injector 1 described above displays a number of advantages because it is easy and cost-effective to implement and displays reduced magnetic inertias with respect to a traditional electromagnetic injector; therefore, fuel injector 1 described above displays a higher speed of movement of needle 15 with respect to a traditional electromagnetic injector.

A series of simulations have demonstrated that fuel injector 1 described above displays a "Linear Flow Range" increased by at least 31% with respect to a traditional electromagnetic injector.

The result described above is obtained in virtue of the considerable reduction of magnetic inertias of electromagnet 8; such reduction of magnetic inertias of electromagnet 8 is obtained in virtue of the contribution of three separate factors:

in virtue of the fact of being "wound in air" (i.e. being free from central spool) coil 11 of electromagnet 8 is very compact (indicatively displaying a total volume lower than 40% with respect to a traditional coil) and therefore allows to reduce the volume (i.e. the mass) of the magnetic circuit;

external magnetic core 34 is formed by a special magnetic material having a high resistivity (indicatively 800-900 times the electrical resistivity of a traditional magnetic material) so as to reduce the effect of eddy currents; and at the gap between magnetic armature 12 and keeper 9, tubular body 4 locally displays a lower magnetic permeability thanks to the contribution of nickel so as to reduce the dispersed magnetic flow which does not cross magnetic armature 12 and keeper 9.

From the foregoing it will be appreciated that, although specific embodiments of the invention have been described herein for purposes of illustration, various modifications may be made without deviating from the spirit and scope of the invention.

The invention claimed is:

1. A fuel injector, comprising:

an injection valve provided with a needle mobile between a closing position and an opening position for regulating the fuel flow through an injection nozzle;

a supporting body having a tubular shape and displaying a feeding channel which ends with the injection valve; and an electromagnetic actuator comprising a spring which tends to maintain the needle in the closing position and an electromagnet, which comprises a coil arranged externally to the supporting body and formed by a wire of conductive material wound to form a plurality of turns, a fixed magnetic armature arranged within the supporting body, and a keeper arranged within the supporting body which is magnetically attracted by magnetic armature against the bias of the spring, and is mechanically connected to the needle;

wherein the coil displays a toroidal shape having an annular internal surface, which is defined by the internal turns of wire and is directly in contact with an external surface of the supporting body without the interposition of any intermediate element; and wherein the wire which constitutes coil comprises a self-cementing type and is coated both with an internal layer of insulating material and an external layer of cementing material which fuses at a temperature lower than that of the insulating material of the internal layer.

2. A fuel injector according to claim 1, wherein an axially measured height of the coil is lower than the width of the radially measured coil.

3. A fuel injector according to claim 1, wherein the electromagnet comprises an external toroidal magnetic core, which is arranged externally to the supporting body and surrounds the coil which is inserted in an annular cavity obtained within the magnetic core itself.

4. A fuel injector according to claim 3, wherein the external magnetic core is formed by a ferromagnetic material having a high electrical resistivity.

5. A fuel injector according to claim 4, wherein the external magnetic core) is formed by a ferromagnetic material having an electrical resistivity at least equal to 100 μΩ*m.

6. A fuel injector according to claim 5, wherein the external magnetic core is formed by Somalloy 3P having an electrical resistivity of approximately 550 μΩ*m.

7. A fuel injector according to claim 3, wherein the magnetic core is inserted within a toroidal coating liner, which is formed by plastic material and co-moulded with magnetic core itself.

8. A fuel injector according to claim 7, wherein a pair of annular seals, which are arranged about supporting body, in contact with toroidal coating liner and on opposite sides of toroidal coating liner are contemplated so as to avoid infiltrations within toroidal coating liner itself.

9. A fuel injector according to claim 7, wherein a metallic tube is contemplated which is mechanically connected to the supporting body and fitted about the toroidal coating liner.

10. A fuel injector according to claim 3, wherein the external magnetic core comprises two toroidal magnetic semi-cores, which are reciprocally overlapped so as to define therebetween the annular cavity in which the coil is arranged.

11. A fuel injector according to claim 10, wherein a magnetic semi-core displays an axial conduit for defining a passage for an electrical wire for powering the coil.

12. A fuel injector according to claim 10, wherein the two magnetic semi-cores are reciprocally and perfectly identical.

13. A fuel injector according to claim 10, wherein the magnetic core is inserted within a toroidal coating liner, which is formed by plastic material and co-moulded along with the magnetic core itself; the construction of the magnetic core contemplates:

arranging a first magnetic semi-core within a mould;

arranging the coil within the mould and over the first magnetic semi-core;

arranging a second magnetic semi-core within the mould and over the first magnetic semi-core so as to form the magnetic core and to enclose the coil along with the first magnetic semi-core; and injecting plastic material within the mould to form the toroidal coating liner (36) about the magnetic core.

14. A fuel injector according to claim 1, wherein the supporting body is formed by ferromagnetic material and displays an substantially non-magnetic intermediate portion, which is arranged at the gap between the magnetic armature and the keeper.

15. A fuel injector according to claim 14, wherein the substantially non-magnetic intermediate position is formed by a local contribution of non-magnetic material.

16. A fuel injector according to claim 15, wherein the substantially non-magnetic intermediate position is formed by a local contribution of nickel.

17. A fuel injector according to claim 15, wherein the making of the substantially non-magnetic intermediate portions contemplates:

making the supporting body entirely of magnetic material, which is homogenous and uniform along the whole supporting body;

arranging a ring of non-magnetic material about the supporting body and at the portion of the gap between the magnetic armature (12) and the keeper; and fusing the ring of non-magnetic material to obtain a local contribution of non-magnetic material in the supporting body.

18. A fuel injector according to claim 17, wherein the non-magnetic material ring is fused by means of a laser beam.

19. A fuel injector, comprising:

an injection valve provided with a needle mobile between a closing position and an opening position for regulating the fuel flow through an injection nozzle;

a supporting body having a tubular shape and displaying a feeding channel which ends with the injection valve; and an electromagnetic actuator comprising a spring which tends to maintain the needle in the closing position and an electromagnet, which comprises a coil arranged outside the supporting body and formed by a wire of conductive material wound to form a plurality of turns, a fixed magnetic armature arranged within the supporting body, and a keeper arranged within supporting body which is magnetically attracted by magnetic armature against the bias of the spring, and is mechanically connected to the needle;

wherein the electromagnet comprises an external toroidal core formed by a ferromagnetic material having a high electrical resistivity; the magnetic core is arranged outside the supporting body and surrounds the coil which is inserted in an annular cavity obtained within the magnetic core itself.

20. A fuel injector according to claim 19, wherein the external magnetic core is formed by a ferromagnetic material having an electrical resistivity at least equal to 100 μΩ*m.

21. A fuel injector according to claim 20, wherein the external magnetic core is formed by Somalloy 3P having an electrical resistivity of approximately 550 μΩ*m.

22. A fuel injector according to claim 19, wherein the magnetic core is inserted within a toroidal coating liner, which is formed by plastic material and co-moulded with the magnetic core itself.

23. A fuel injector according to claim 22, wherein a pair of annular seals are contemplated, which are arranged around supporting body, in contact with toroidal coating liner and on opposite sides of toroidal coating liner, so as to avoid infiltrations within toroidal coating liner itself.

24. A fuel injector according to claim 22, wherein a metallic tube is contemplated which is mechanically connected to the supporting body and fitted about the toroidal coating liner.

25. A fuel injector according to claim 19, wherein the external magnetic core comprises two toroidal magnetic semi-cores, which are reciprocally overlapped so as to define therebetween the annular cavity in which the coil is arranged.

26. A fuel injector according to claim 25, wherein a magnetic semi-core displays an axial conduit for defining a passage for an electrical wire for powering the coil.

27. A fuel injector according to claim 26, wherein the two magnetic semi-cores are reciprocally and perfectly identical.

28. A fuel injector according to claim 25, wherein the magnetic core is inserted within a toroidal coating liner, which is formed by plastic material and co-moulded with the magnetic core itself; the construction of the magnetic core contemplates:

arranging a first magnetic semi-core within a mould;

arranging the coil within the mould and over the first magnetic semi-core;

arranging a second magnetic semi-core within the mould and over the first magnetic semi-core so as to form the magnetic core and to enclose the coil along with the first magnetic semi-core; and injecting plastic material within the mould to form the toroidal coating liner around the magnetic core.

29. A fuel injector, comprising:

an injection valve provided with a needle mobile between a closing position and an opening position for regulating the fuel flow through an injection nozzle;

a supporting body having a tubular shape and displaying a feeding channel which ends with the injection valve; and an electromagnetic actuator comprising a spring which tends to maintain the needle in the closing position and an electromagnet, which comprises a coil arranged externally to supporting body and formed by a wire of conducing material wound to form a plurality of turns, a fixed magnetic armature arranged within the supporting body, and a keeper arranged within supporting body which is magnetically attracted by magnetic armature against the bias of the spring, and is mechanically connected to the needle;

wherein the coil displays a toroidal shape having an annular internal surface, which is defined by the internal turns of wire and is directly in contact with an external surface of the supporting body without the interposition of any intermediate element; and wherein the electromagnet comprises an external toroidal magnetic core, which is arranged externally to the supporting body and surrounds the coil which is inserted in an annular cavity obtained within the magnetic core itself.

30. A fuel injector according to claim 29, wherein the external magnetic core is formed by a ferromagnetic material having a high electrical resistivity.

31. A fuel injector according to claim 30, wherein the external magnetic core is formed by a ferromagnetic material having an electrical resistivity at least equal to 100 μΩ*m.

32. A fuel injector according to claim 31, wherein the external magnetic core is formed by Somalloy 3P having an electrical resistivity of approximately 550 μΩ*m.

33. A fuel injector according to claim 29, wherein the magnetic core is inserted within a toroidal coating liner, which is formed by plastic material and co-moulded with magnetic core itself.

34. A fuel injector according to claim 33, wherein a pair of annular seals, which are arranged about supporting body, in contact with toroidal coating liner and on opposite sides of toroidal coating liner are contemplated so as to avoid infiltrations within toroidal coating liner itself.

35. A fuel injector according to claim 33, wherein a metallic tube is contemplated which is mechanically connected to the supporting body and fitted about the toroidal coating liner.

36. A fuel injector according to claim 29, wherein the external magnetic core comprises two toroidal magnetic semi-cores, which are reciprocally overlapped so as to define therebetween the annular cavity in which the coil is arranged.

37. A fuel injector according to claim 36, wherein a magnetic semi-core displays an axial conduit for defining a passage for an electrical wire for powering the coil.

38. A fuel injector according to claim 36, wherein the two magnetic semi-cores are reciprocally and perfectly identical.

39. A fuel injector according to claim 36, wherein the magnetic core is inserted within a toroidal coating liner, which is formed by plastic material and co-moulded along with the magnetic core itself; the construction of the magnetic core contemplates:

arranging a first magnetic semi-core within a mould;

arranging the coil within the mould and over the first magnetic semi-core;

arranging a second magnetic semi-core within the mould and over the first magnetic semi-core so as to form the magnetic core and to enclose the coil along with the first magnetic semi-core; and injecting plastic material within the mould to form the toroidal coating liner (36) about the magnetic core.

* * * * *